United States Patent [19]

Vitols

[11] 4,248,116

[45] Feb. 3, 1981

[54] GUARDS FOR CUTTING INSTRUMENTS

[75] Inventor: Reinhards Vitols, Tollerton, England

[73] Assignee: National Research Development Corporation, London, England

[21] Appl. No.: 71,571

[22] Filed: Aug. 31, 1979

[30] Foreign Application Priority Data

Sep. 5, 1978 [GB] United Kingdom ..... 35583/78

[51] Int. Cl.[3] ..... D06H 7/00; B26D 7/22

[52] U.S. Cl. ..... 83/544; 83/397; 83/925 CC

[58] Field of Search ..... 83/397, 544–546, 83/925 CC; 30/201, 202, 286, 295

[56] References Cited

U.S. PATENT DOCUMENTS 2,538,456 1/1951 Howe, Jr. ..... 83/544 X

*Primary Examiner*—J. M. Meister

*Attorney, Agent, or Firm*—Cushman, Darby & Cushman

[57] ABSTRACT

A guard for moving-blade cutting instruments, for instance band-saws and band-knives. The guard is in the form of a comb or other toothed member, mounted alongside the blade and vibrated cyclically so that the tips of the teeth lie proud of the cutting edge at least once per cycle. The clearances between the teeth are aligned so as to facilitate access of piles of cloth or the like to the blade, but the bulkier fingers of the operator should be struck by the tips of the vibrating comb and repelled before being seriously cut, or cut at all, by the blade. The guard may be mounted to yield within limits, so as to increase the exposure of the blade, when subjected to sustained pressure from approaching work.

9 Claims, 4 Drawing Figures

GUARDS FOR CUTTING INSTRUMENTS

This invention relates to cutting instruments with moving blades, and to guards for those blades. By such blades we mean to include both saws and knives, and in particular band-saws and band-knives. The invention applies particularly to band knives of the kind now commonly used in the clothing industry to cut a lay, that is to say a pile of pieces of flexible material laid flat one above the other, to a common shape for use as one component of a mass-produced garment. Band knives are notoriously dangerous, and with band knives used for this purpose it has proved exceptionally difficult to devise an effective guard for the knife that does not also impede the operator in his task of addressing the lay to the knife, and that does not resist the natural parting of the lay as it moves on past the knife after cutting.

According to the invention a guard for a moving-blade cutting instrument comprises a cyclically-vibratable toothed member to be mounted alongside the blade, the points of the teeth lying slightly proud of the blade edge at at least one moment in the vibratory cycle. The member may be comb-like and the clearance between teeth are aligned with the direction in which the work moves past the blade during use.

The member may be mounted to vibrate in a direction substantially parallel to the direction of movement of the work, and the vibrations may include components either aligned with that direction, or perpendicular to it, or may include both of these components.

There may be two toothed members, located one to each side of the blade. At at least one moment in each cycle of vibration the points of the teeth of both members may lie proud of the cutting edge, one member lying slightly more so than the other, or alternatively the points of the teeth of the second member may lie less than proud of the blade edge. The two members may constitute the legs of a unitary structure of "U"-section, the blade lying within the "U".

The guard may be mounted to yield, within a limited distance, when work is advanced towards the blade and makes contact with guard; this distance may be sufficient to retract the or each member of the guard until no tooth points lie proud of the blade edge any longer. The guard may constitute a link within a system of pivoted, swinging links and may be biassed to its normal, undeflected position by a weight; this weight may be provided by the motor which creates the vibration.

The invention also includes a cutting instrument comprising such a guard, in which the line of the blade edge remains constant during use. The blade may, for instance, be that of a continuous-type knife or saw, arranged for one-directional movement during use. Alternatively the blade could execute oscillating movement. The instrument could also include a working surface over which work may be caused to slide to approach the blade, and blade and guard may both pass through a hole formed in the surface.

The invention will now be described, by way of example, with reference to the accompanying drawings in which.

Figure 1:
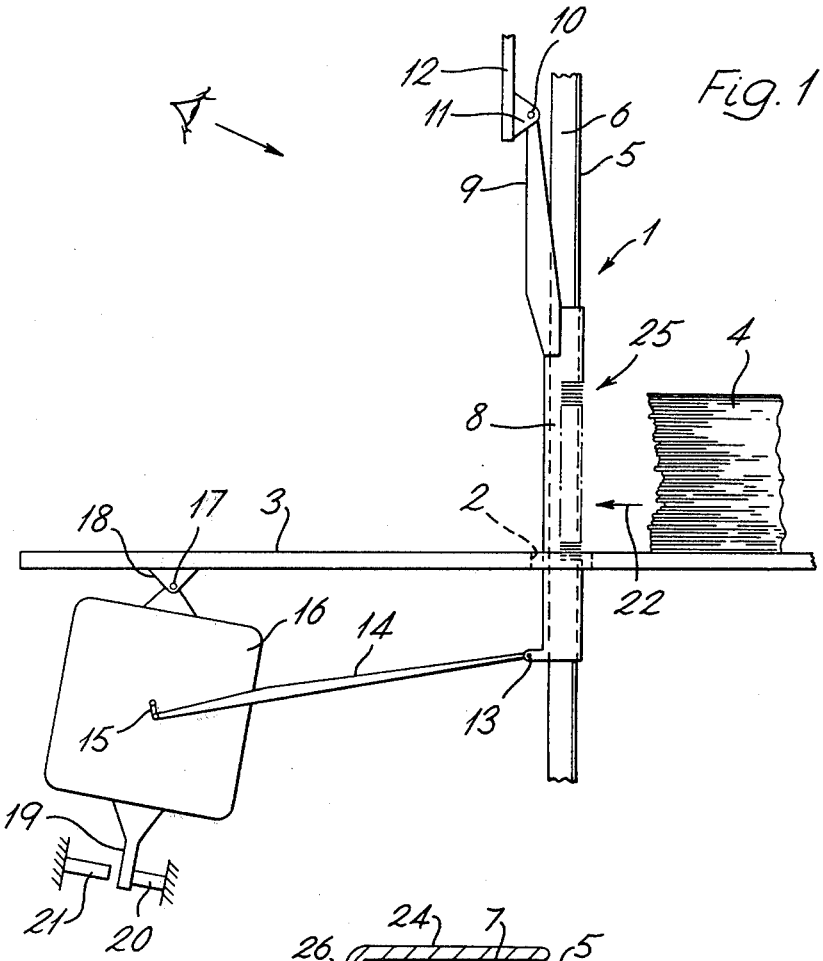
FIG. 1 is an elevation.

The illustrated cutting instrument comprises a vertical band knife 1, guided and driven by the customary rollers and motor (not shown) and passing through a hole 2 formed in a horizontal work table 3 over which work 4 is moved by sliding to meet the knife. The illustrated work 4 is a pile or "lay" of sheets of textile material, which will be cut by the knife to the shape required for a chosen garment component. The references 5, 6 and 7 indicate respectively the cutting edge and two side faces of the knife blade 1.

A guard 8 for the knife comprises a length of metal strip bent to "U" section. One end of the length is fixed to an arm 9 pivoted at 10 to a bracket 11 fixed to the frame 12 of the instrument. The other end of guard 8 is pivoted at 13 to an arm 14 pivoted at its other end to a crank arm 15 driven by a motor 16 pivoted in turn at 17 to a bracket 18 fixed to the underside of work table 3. A stub 19 projecting from motor 16 on the opposite side from pivot 17 moves between two stops 20 and 21. When the pivoted linkage system comprising guard 8, arm 14 and motor 16 is hanging freely, with no force being exerted upon guard 8 in the direction of the arrow 22 (FIG. 1) stub 19 rests against stop 20. When a force is exerted upon guard 8 in the direction of arrow 22, as by the approach of the lay 4, the guard yields a little and the system swings to the left until stub 19 meets top 21. Arrow 22 also indicates the direction of motion of the work relative to the knife.

Figure 2:
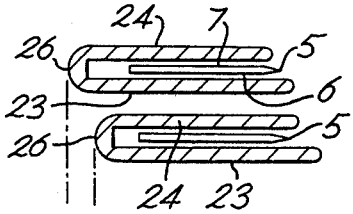
FIG. 2 shows sections through a blade lying within a guard, the sections being taken at opposite extreme positions of the vibratory movement of the guard.

As FIG. 2 most clearly shows, guard 8 is of "U"-section, the two arms of the "U" having rounded ends and being referenced 23, 24. The body of blade 1 lies between the two arms of the guard. As FIG. 1 shows, the leading edges of the arms of the guard are formed with comb-like slots 25.

FIG. 2 shows the position of blade 1 relative to the guard 8 at the two opposite extreme positions of the vibratory movement of the latter. The upper half of the Figure shows the guard at its most rearward position relative to the blade, with the teeth of arm 23 lying proud of edge 5 and those of arm 24 almost level with it, while the lower half of the Figure shows the teeth of both arms 23 and 24 proud of edge 5. Thus when motor 16 is rotating crank 15 (at 50 Hz, for example) so that the arms are oscillating back and forth at the same frequency, the blade edge is always guarded by at least one of the arms should an operator move his hand towards the blade in the same direction as that in which work normally approaches it, and when he touches the guard the high frequency vibration will be unpleasant but not dangerous to touch, and will tend to make him draw his hand away. Adequate amplitude of the fore-and-aft vibration of the guard may be of the order of 3 mm. When work is addressed to blade 1, guard 8 can yield but in practice may do so little, because provided the comb slots 25 are at least as wide as the individual "layers" of the lay they enable the forward edges of the layers to reach the edge 5 of the blade. It is believed that the slots also help to steady the individual layers of material as the blade cuts them, that the different tip locations of arms 23 and 24-one in front of the other-helps to aid penetration of the comb by the layers, and that the vibration may tend to part the severed edges of the material after cutting so that they lose contact with the side faces 6, 7 of blade 1 and also clear the base 26 of the "U" of guide 8.

A mass of 8 kg for motor 16, and of about one-thirtieth of that for the driven linkage (arms 9 and 14, and guard 8) have been fond satisfactory in practice.

The essential features of guard 8 may be summarised by saying that the teeth of the arms must be robust enough as they vibrate to repel the flesh of an intruder, and that the gaps or slots between the teeth should be as large as possible without allowing human fingers to reach edge 5.

Figure 4:
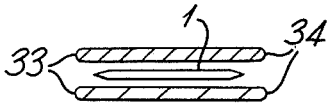
FIGS. 3 and 4 are sections through blades lying within alternative forms of guard.
Figure 3:
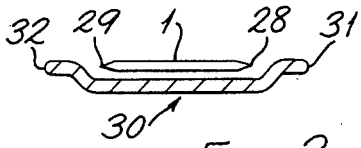

In the alternative construction shown in FIG. 3 the knife blade 1 is sharp at both ends 28, 29 and is protected by a single guard 30, the tips 31, 32 of which are formed with comb-like slots (as shown at 25 in FIG. 1) and are bent out-of-plane with the rest of the section of the guard so that they align with the plane of the blade 1. Tips 31, 32 thus lie directly forward of cutting edges 28, 29, so protecting them better than they would if located laterally of the edges. FIG. 4 shows a construction similar to that of FIG. 2 except that the knife blade 1 is double-edged as in FIG. 3 and there are two separate guards, each with slots at both tips 33 and 34, instead of a single "U"-shaped guard.

I claim:

1. For use with a moving-blade cutting instrument, a guard comprising:

a toothed member for mounting alongside said moving blade;

motor means to vibrate said toothed member cyclically;

points presented by the teeth of said toothed member;

said points lying slightly proud relative to said moving blade at at least one moment in the cycle of said cyclical vibration.

2. A guard according to claim 1, in which said toothed member is of comb-like form, in which clearances separate said teeth of said comb-like toothed member, and in which said teeth and said clearances are aligned with the direction in which work to be cut moves past said moving blade during use.

3. A guard according to claim 2, in which said toothed member is mounted to vibrate in a plane substantially parallel both to said moving blade and to said direction in which work moves past said moving blade during use.

4. A guard according to claim 1 having two of said toothed members, one located to each side of said moving blade.

5. A guard according to claim 4 including a unitary structure of "U"-section, in which said moving blade lies within said "U" and in which said two toothed members constitute the two legs of said "U".

6. A guard according to claim 1 including a pivotal mounting which enables said guard to deflect, within a limited distance, when work is advanced towards said moving blade and makes contact with said guard.

7. A guard according to claim 6 in which said pivotal mounting includes biassing means to bias said guard to its normal, undeflected position.

8. A guard according to claim 7 in which said motor means constitutes said biassing means.

9. A cutting instrument comprising:

a moving cutting blade;

a toothed comb-like member mounted alongside said blade;

means to vibrate said toothed member cyclically;

points presented by the teeth of said comb-like toothed member, the mode of said cyclical vibration being such that said points lie slightly proud of said moving blade at at least one moment in said cycle of vibration;

a working surface over which work may be caused to slide to approach said blade and said toothed member, and a hole formed in said working surface, said moving blade and said toothed member extending on both sides of said working surface and passing through said hole.

* * * * *